US006939242B1

(12) United States Patent
Battersby

(10) Patent No.: US 6,939,242 B1
(45) Date of Patent: Sep. 6, 2005

(54) GOLF INSTRUCTION APPARATUS AND METHOD

(75) Inventor: Gary Battersby, 6620 Las Flores Dr., Boca Raton, FL (US) 33433

(73) Assignee: Gary Battersby, Boca Raton, FL (US)

( * ) Notice: Subject to any disclaimer, the term of this patent is extended or adjusted under 35 U.S.C. 154(b) by 0 days.

(21) Appl. No.: 10/217,193

(22) Filed: Aug. 9, 2002

Related U.S. Application Data

(63) Continuation-in-part of application No. 09/566,965, filed on May 5, 2000, now abandoned, which is a continuation-in-part of application No. 09/312,399, filed on May 14, 1999, now abandoned.

(51) Int. Cl.[7] ..... A63B 69/36
(52) U.S. Cl. ..... 473/219; 473/257
(58) Field of Search ..... 473/257–265, 473/219

(56) References Cited

U.S. PATENT DOCUMENTS 1,005,948 A * 10/1911 English ..... 473/260
1,634,102 A 7/1927 Hansen
1,670,409 A 5/1928 Hansen
3,482,838 A * 12/1969 Gibson ..... 473/264
4,071,251 A 1/1978 Beckish
4,852,881 A 8/1989 Bellagamba et al.
4,869,510 A 9/1989 Battersby
4,919,432 A 4/1990 Coggins et al.
4,927,152 A * 5/1990 Graham ..... 473/265
4,928,974 A 5/1990 VanKirk
5,423,548 A * 6/1995 Bricker ..... 473/258
5,984,798 A * 11/1999 Gilmour ..... 473/221

* cited by examiner

*Primary Examiner*—Vishu K. Mendiratta
(74) *Attorney, Agent, or Firm*—Akerman Senterfitt; Gregory A. Nelson; Theodore M. Green

(57) ABSTRACT

A golf apparatus includes an elastically deformable, elongated guide member having a guide member edge which is bendable by a user into an arc having a certain desired curvature substantially matching the arc of a desired swing of a golf clubhead. The guide member substantially retains the shape into which it is bent until reshaped by the user. A golfer is able to practice swinging a golf club at full speed along a desired swing path by swinging the head of the club along the arc of the guide member edge. The guide member yields to contact of the swinging golf clubhead preventing damage of the golf clubhead and the guide member.

19 Claims, 7 Drawing Sheets

GOLF INSTRUCTION APPARATUS AND METHOD

This application is a continuation-in-part of application Ser. No. 09/566,965, filed May 5, 2000, now abandoned, which is itself a continuation-in-part of application Ser. No. 09/312,399, filed May 14, 1999, now abandoned.

BACKGROUND OF THE INVENTION

1. Field of the Invention

The present invention relates generally to the field of playing and training equipment. More specifically the present invention relates to a golf apparatus for training a golfer to swing his or her club along a proper arc. The apparatus preferably includes an elongate, malleable guide member having a guide member edge, the guide member being hand-bendable by a user so that the guide member edge follows an arc having a certain desired curvature substantially matching the arc of a desired swing of a golf clubhead. The guide member substantially retains the shape into which it is bent until reshaped by the user. The guide member is constructed of malleable aluminum wire covered by a circumferential layer of light, flexible foam. The malleable guide member is secured to the ground using an anchoring member. The guide member extends upwardly from the ground such that a golfer is able to swing a golf clubhead along the arc of the guide member at full speed, using the guide member as a guiding boundary for a desired swing path. Clubhead contact with the guide member causes the guide member to yield to the force of a swinging clubhead so that the clubhead and guide member are not damaged.

A method is provided of performing a practice swing of a golf club using the above described apparatus including the steps of: 1) bending the guide member such that the guide member edge forms an arc substantially matching a desired golf clubhead swing path; 2) securing the guide member relative to the ground in such an orientation relative to the ground as to define a desired swing path relative to the ground; 4) swinging the club along the guide member edge.

2. Description of the Prior Art

There have long been training aids for learning to play the game of golf A few have been directed to improving the swing of the player, so that the player swings along a path considered by professionals to be the most effective in propelling the ball over a desired distance and with accuracy. Some provide guide structures along which the golfer swings his or her club. These guide structures are generally of fixed curvature, or at least the curvature defining the swing path cannot be altered conveniently by user hand manipulation, and the apparatus tends to be costly.

Examples of such prior devices are Battersby, U.S. Pat. No. 4,869,510, issued on Sep. 26, 1989, for a golf instruction apparatus and method employing a flexible elongate guide member fixed between end support structures; Beckish, U.S. Pat. No. 4,071,251, issued on Jan. 31, 1978, for a golf swing training device having a pair of adjustable guide rails for controlling the swing path and swing plane of the golf club swung between, the guide rails being held in a given configuration by telescoping rods; Hansen, U.S. Pat. No. 1,634,102, issued on Jun. 28, 1927, for a mechanical golf instructor and exerciser apparatus including a pair of substantially circular tracks, a golf stick slidable on the tracks, the tracks being provided at their upper sides with means for reversing the movement of the guide, and a subsequent, very similar structure disclosed in Hansen, U.S. Pat. No. 1,670, 409, issued on May 22, 1928; Bellagamba, et al. U.S. Pat. No. 4,852,881 issued on Aug. 1, 1989, for a golf training apparatus having a frame with a base and a first golf club swing guide attached to the frame for guiding a players swing of a golf club; VanKirk, U.S. Pat. No. 4,928,974, issued on May 29, 1990, for a golf swing trainer, including several flexible cantilever supported feelers which are mounted on a ring on a column support so that the free end of the feeler elements are located in a predetermined position to the golfer whereby departure of the golf club path of movement from the proper path causes the golf club shaft to engage a feeler free end and indicate to the golfer the correction is required; Coggins, et al., U.S. Pat. No. 4,919,432, issued on Apr. 24, 1990, for a golf swing guide with back—swing indicator including a circular guide which engages the shaft of the golf club to guide the club through a golf swing.

It is thus an object of the present invention to provide a golf instruction apparatus and method which includes a guide member which defines a guide line corresponding to a desired or proper swing path along which a player can practice swinging his or her golf club.

It is another object of the present invention to provide such a golf instruction apparatus and method which permits and involves the step of hand bending the apparatus guide member to adjust the curvature of the guide line the guide member defines for adapting the apparatus to train specifically for different swings in different situations and for different players, and which yields to prevent damage to the apparatus or to the club upon club impact with the guide member.

It is still another object of the present invention to provide such a golf instruction apparatus and method which provides golf clubhead position indicating markers along the guide member indicating by their orientation the desired or proper orientation of the golf clubhead at each corresponding point along the path of club swing.

It is another object of the present invention to provide such a golf instruction apparatus and method which utilizes an anchoring member to quickly and removably connect an end of the guide member to the ground.

It is finally an object of the present invention to provide such a golf instruction apparatus which is inexpensive to manufacture, which can be hand folded into a compact carrying configuration, which is light weight and easy to use.

SUMMARY OF THE INVENTION

The present invention accomplishes the above-stated objectives, as well as others, as may be determined by a fair reading and interpretation of the entire specification.

A golf apparatus is provided including a malleable guide member having a guide member edge, the guide member which is bendable by a user into an arc having a certain desired curvature substantially matching the arc of a desired swing of a golf clubhead, and which substantially retains the shape into which it is bent until reshaped by the user, and a guide member anchoring device which comprises a locking clip adapted for attachment to an end of the guide member for securing the guide member to the ground to position the guide member extending upwardly from the ground such that a golfer is able to practice swinging a golf club at fill speed along a desired swing path by swinging the head of the club along the arc of the guide member edge, and such that the malleable guide member yields to contact of the swinging golf clubhead and thereby prevents damage of the golf clubhead and the guide member.

A method is provided of performing a practice swing of a golf club using the above described apparatus including the steps of: 1) bending the guide member such that the guide member edge forms an arc substantially matching a desired golf clubhead swing path, 2) securing the guide member relative to the ground in such an orientation relative to the ground as to define a desired swing path relative to the ground by extending the anchoring member through the guide member bore and affixing to the ground; 3) swinging the club along the guide member edge.

A further method is provided of performing a practice swing of a golf club using the above described apparatus including the steps of: 1) bending the guide member into a generally U-shaped portion having respective parallel legs, and a connecting leg that lie in a common plane, and a tail that is bent perpendicular to leg outwardly from the plane of the U-shaped portion such that tail lies in a median position between a desired initial clubhead position prior to the back swing and a desired golf ball contacting clubhead position during the downswing prior to contacting the golf ball B; 2) securing the guide member relative to the ground with the plane extending upwardly from the ground with the tail at the median position by extending the anchoring member through the guide member bore and affixing relative to the ground; 3) placing clubhead at the desired initial clubhead position; and 4) swinging the club with the clubhead passing under the tail during the back swing and over the tail during the downswing through the golf ball contacting position prior to contacting the golf ball.

BRIEF DESCRIPTION OF THE DRAWINGS

Various other objects, advantages, and features of the invention will become apparent to those skilled in the art from the following discussion taken in conjunction with the following drawings, in which:

FIG. 13 shows an S-curve bend in the guide member to follow an in-to-out path relative to the target line, before and after impact of the club on the ball.

DETAILED DESCRIPTION OF THE PREFERRED EMBODIMENTS

Figure 1:
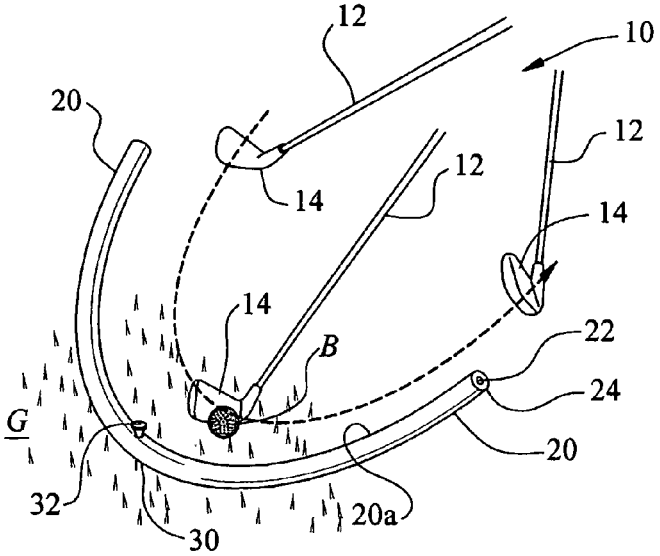
FIG. 1 is a perspective view of the apparatus in which one guide member is secured to the ground with a stake passing through the guide member anchor port, the guide member leaning over the golf ball. A club is shown in three positions along its swing path, the swing path being represented by a broken line with an arrow tip indicating swing direction.

As required, detailed embodiments of the present invention are disclosed herein; however, disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 2:
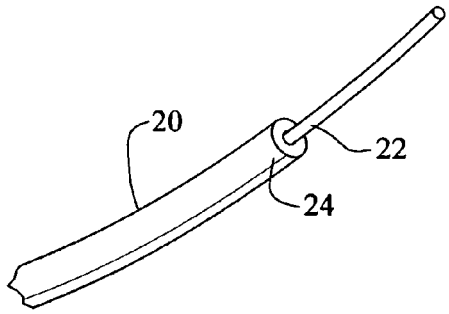
FIG. 2 is a broken away, partial perspective view of one of a guide member, showing the foam exterior and the axially located malleable wire within the foam exterior for holding the guide member shape.
Figure 3:
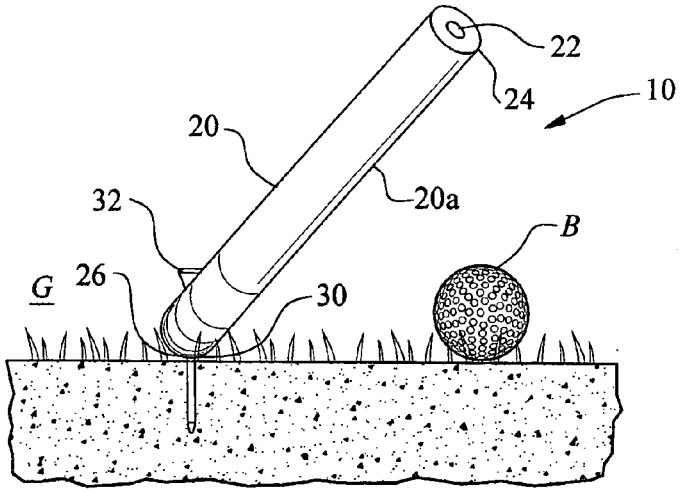
FIG. 3 is a vertical cross-section of the ground with a leaning guide member anchored to the ground with a stake as in FIG. 1, and a golf ball in position to be driven.
Figure 4:
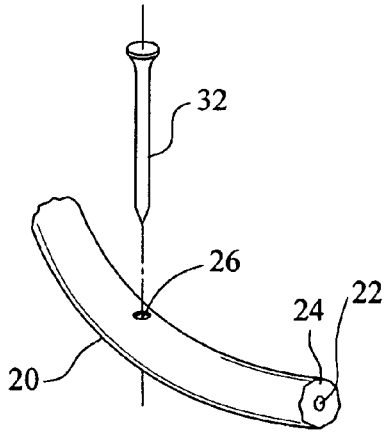
FIG. 4 is a broken-away perspective view of a guide member and the anchor stake and guide member anchor port through which the stake is to pass to enter the ground.
Figure 5:
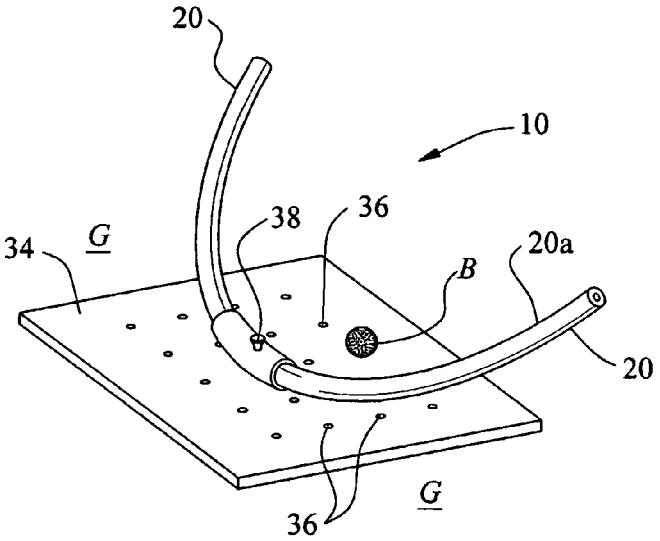
FIG. 5 is a perspective view of the apparatus anchored relative to the ground using the platform mat guide member anchoring structure, with a golf ball positioned on the platform mat ready to be struck.
Figure 6:
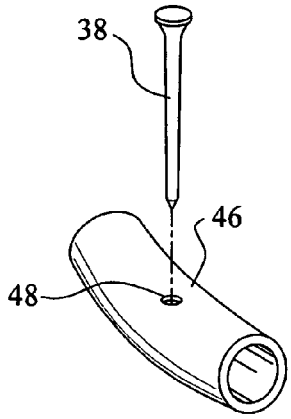
FIG. 6 is a perspective view of a junction tube for interconnecting two guide member segments, and of the stabilizer pin positioned to pass through the junction tube diametric bore and into a port in a platform mat.
Figure 7:
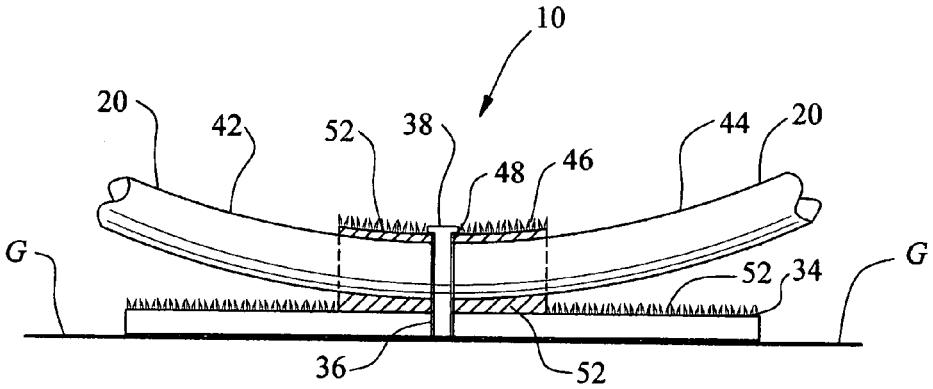
FIG. 7 is a cross-sectional side view of the junction tube resting on a platform mat and receiving ends of two guide member segments, with the stabilizer pin passing through the junction tube into a port in the platform mat.
Figure 8:
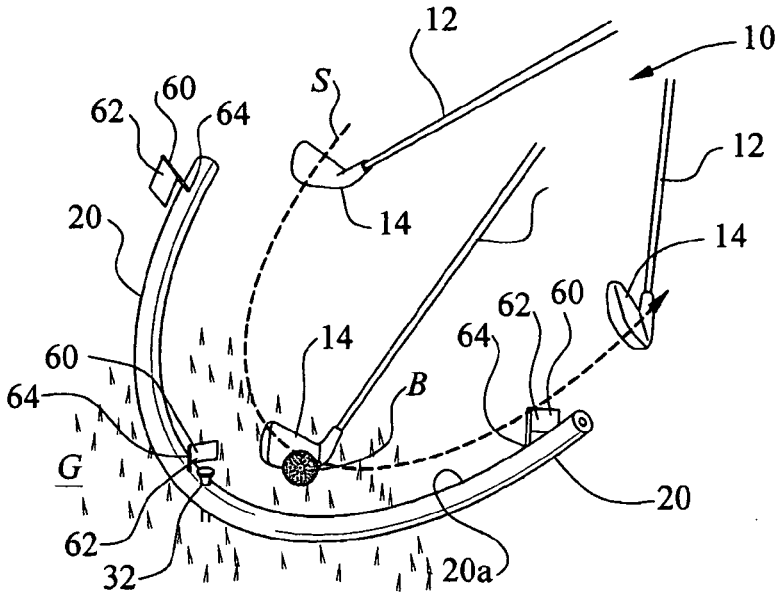
FIG. 8 is a view as in FIG. 1, with three of the optional clubhead orientation markers added.
Figure 9:
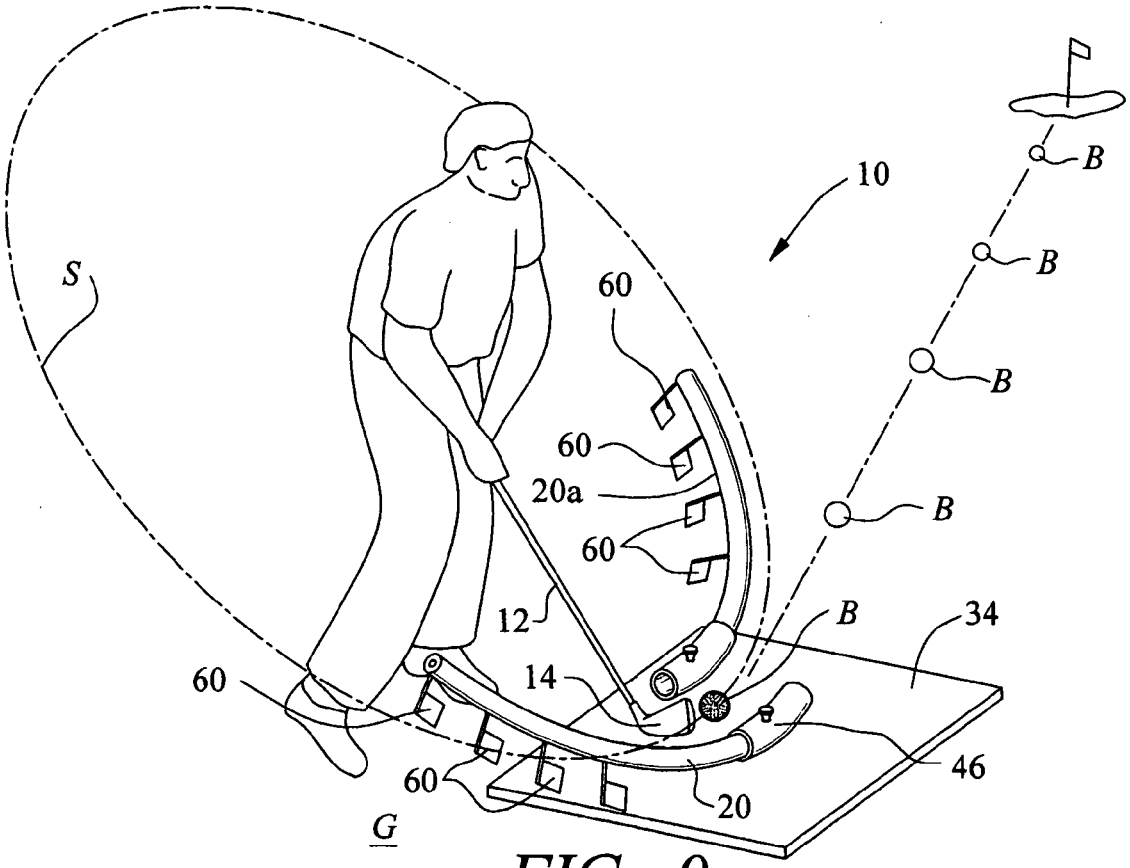
FIGS. 9–13 are exemplary perspective views of the apparatus having various optional guide member arrangements on the platform mat.
Figure 10:
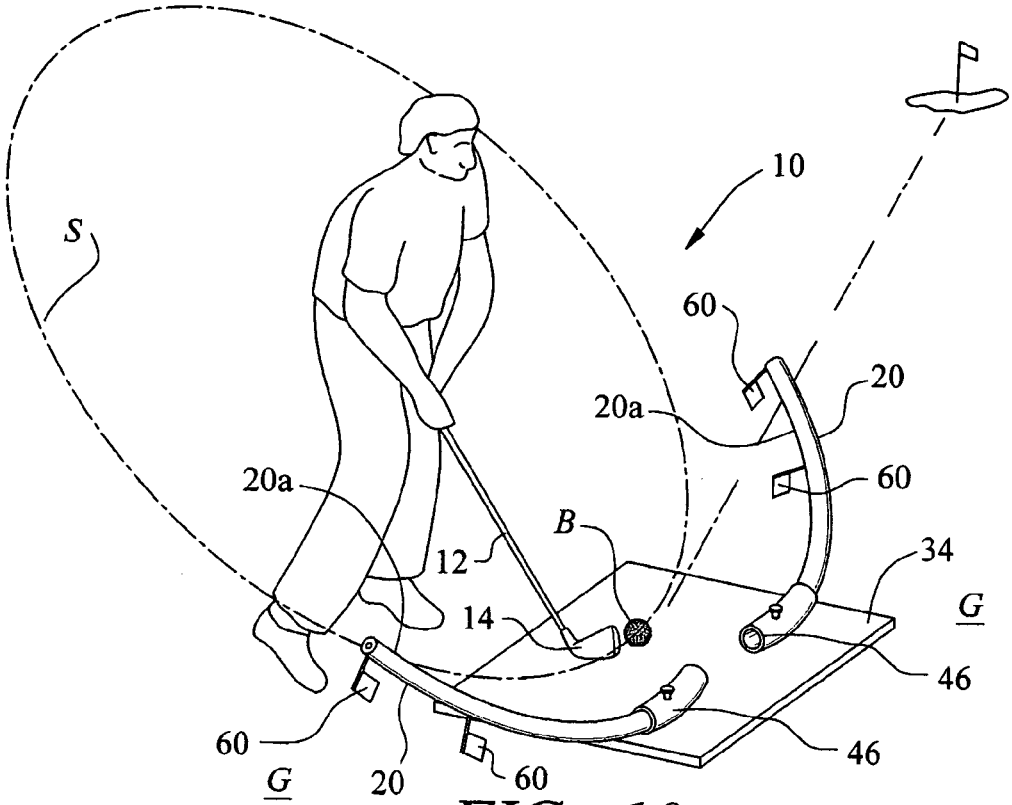
Figure 11:
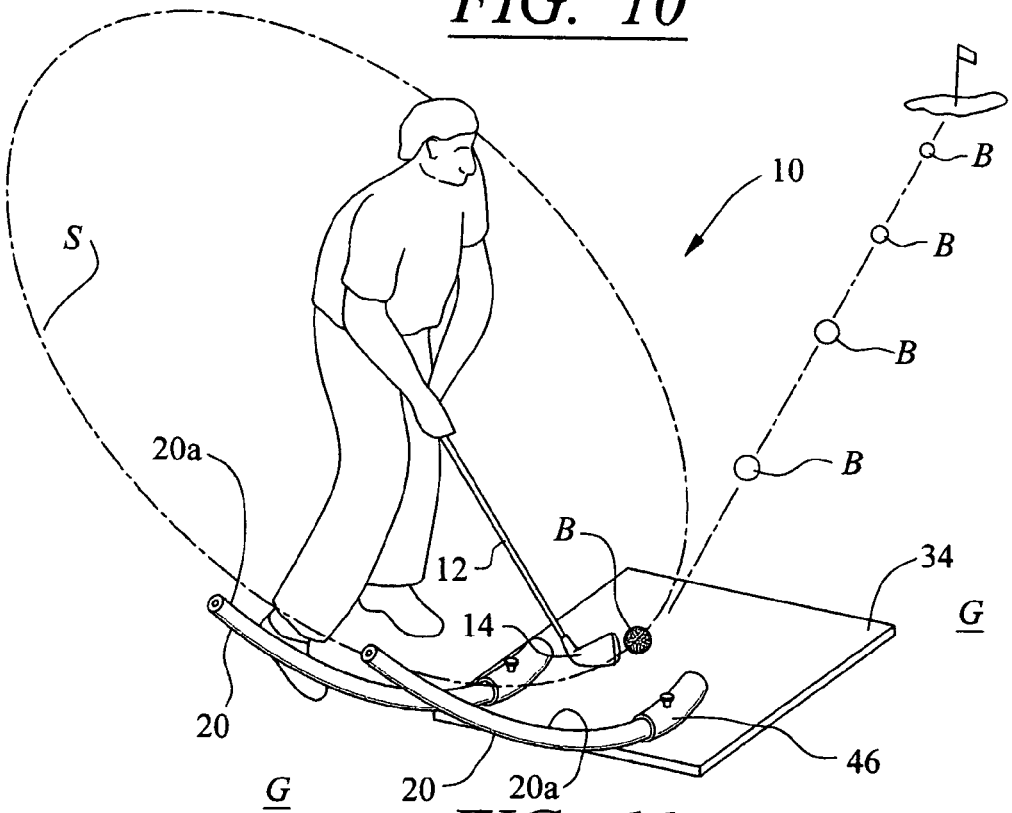
Figure 12:
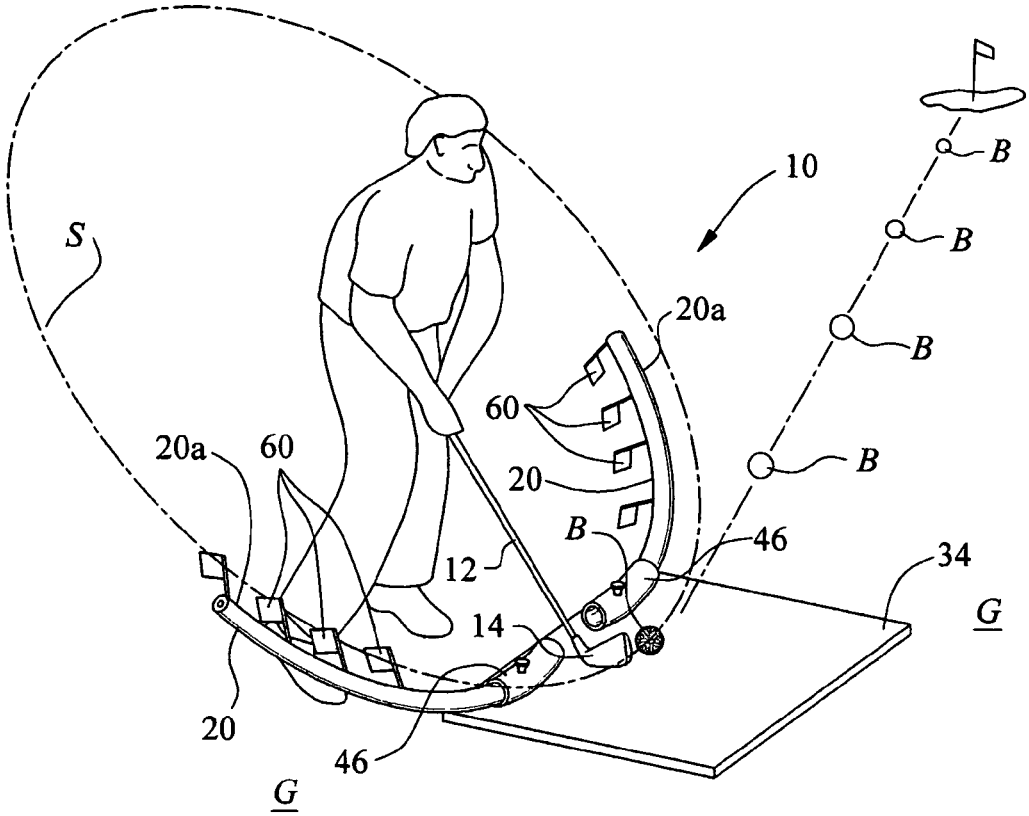
Figure 13:
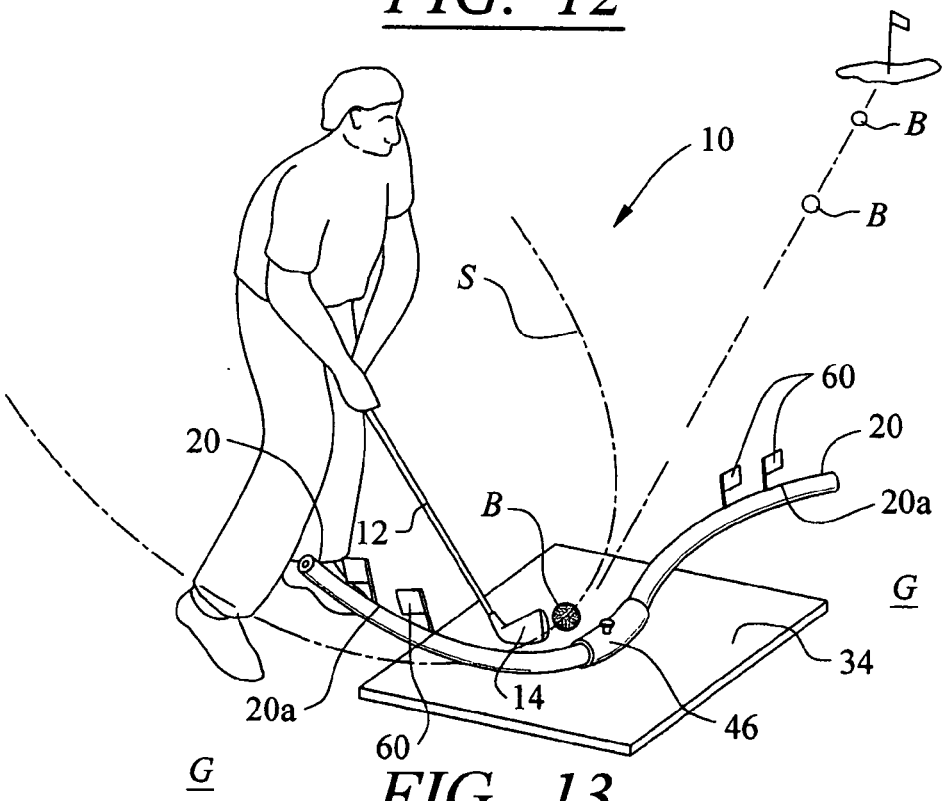
Figure 14:
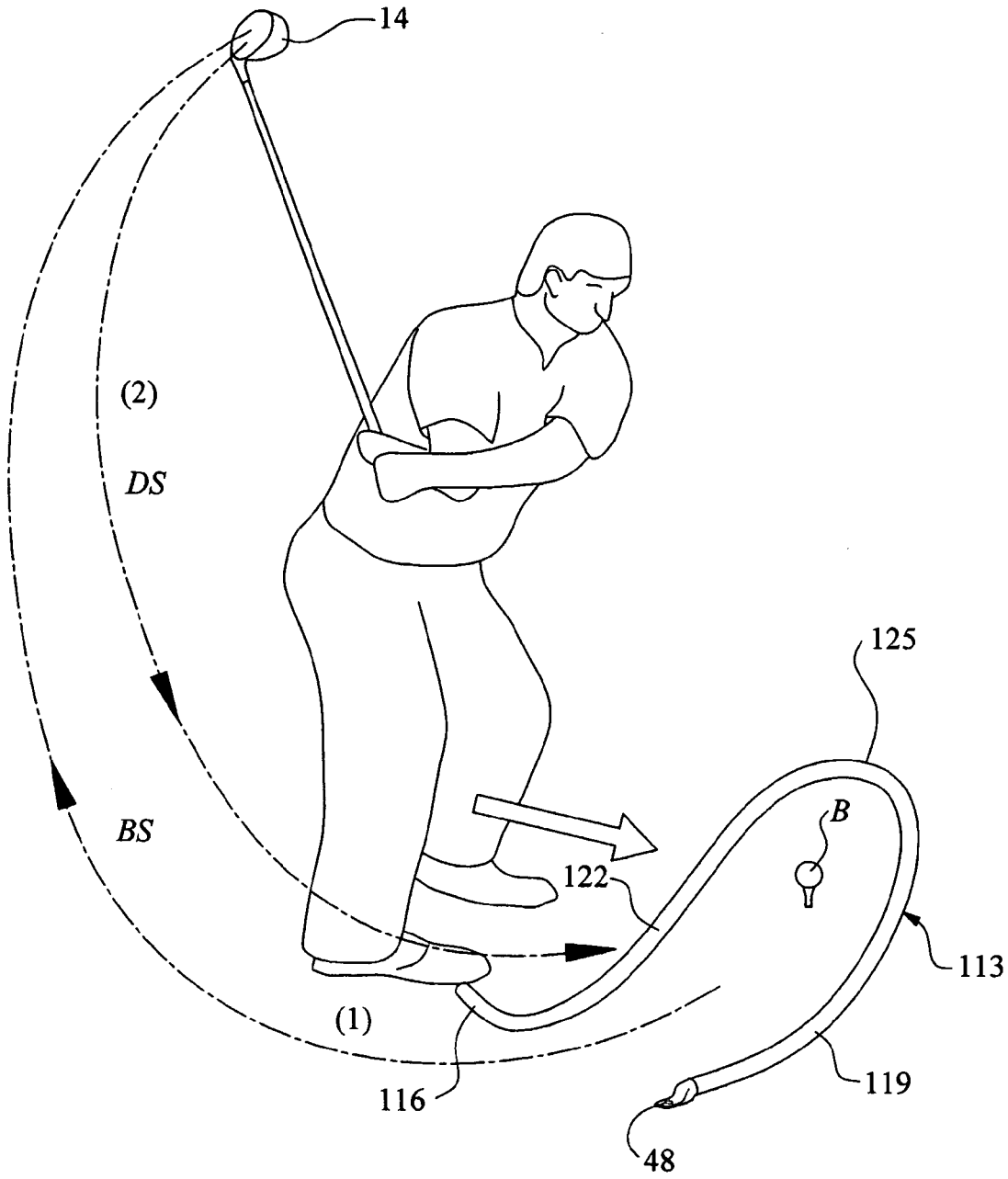
FIG. 14 is a perspective view of the guide member segment bent into a U-shape with a tail for controlling the clubhead position at contact with the golf ball.
Figure 15:
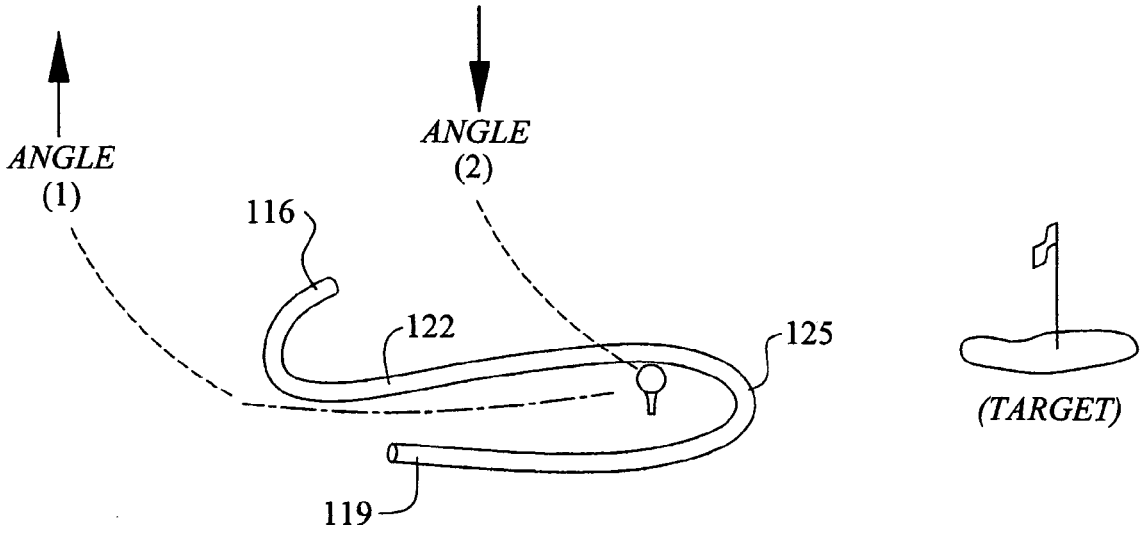
FIG. 15 is a front perspective view of the swing paths of FIG. 14.

Referring to FIGS. 1–13, a golf apparatus 10 is disclosed for training a golfer to swing his or her club 12 along a proper arc. Apparatus 10 preferably includes an elongate, malleable guide member 20 having a guide member edge 20*a*, the guide member 20 being hand-bendable by a user so that the guide member edge follows an arc having a certain desired curvature substantially matching the arc of a desired swing of a golf clubhead 14. As a result, the shape of guide member edge 20*a* can be customized to bend at any curvature or angle a golf instructor chooses to help create the optimum path and plane for each individual student and for each situation. The guide member 20 substantially retains the shape such as an S-curve into which it is bent until reshaped by the user. Guide member 20 is constructed of malleable wire 22, preferably of aluminum, covered by a circumferential layer of light, flexible foam 24, which is preferably a closed cell foam. See FIG. 2. The malleable guide member 20 is secured to the ground G with a guide member anchoring structure 30 and extends upwardly from the ground. The guide member 20 is preferably tilted laterally to lean over the golf ball B, so that the club must travel below the guide member 20 to flatten the angle. See FIGS. 1 and 2. A golfer is able to swing a golf clubhead 14 along the arc of the malleable guide member 20 at full speed, using the guide member as a guiding boundary for a desired swing path S, and clubhead 14 contact with malleable guide member 20 causes the malleable guide member 20 to yield to the force of a swinging clubhead 14, so that the clubhead 14 and guide member 20 are not damaged.

The guide member anchoring structure 30 optionally includes a guide member anchor port 26 in the malleable guide member 20 and a stake 32 such a golf tee passing through the guide member anchor port 26 for insertion into the ground G. See FIGS. 1, 3 and 4. The guide member anchoring structure 30 alternatively includes a platform mat 34 which preferably is made of neoprene to grip common floor surfaces such as those of wood, or to grip carpet or the ground outdoors, the platform mat 34 preferably having artificial grass on its upper surface and having at least one platform mat port 36. A stabilizer pin 38 is fitted through the guide member port 26 and the at least one platform mat port 36, thereby interconnecting the guide member 20 and the platform mat 34. See FIGS. 5 and 7. In this way, the platform mat 34 is caused to function as a stabilizing platform on which the malleable guide member 20 is supported on the ground G. The platform mat 34 preferably includes several platform mat ports 36 so that several of the guide members 20 may be connected to the platform mat 34 for extending the arc along which a golf swing may be guided, or so that two parallel and laterally spaced apart guide members 20 may be secured to the mat 34 to swing a clubhead 14 between. See FIGS. 9–12.

The guide member 20 is optionally divided into guide member segments 42 and 44 which may be used separately or may be connected end to end to form a composite guide member 20. End to end guide member segment connection is accomplished by fitting the segment 42 or 44 ends to be joined into opposing ends of a guide member junction tube 46. See FIGS. 6 and 7. The interior diameter of the junction tube 46 is preferably close enough to the exterior diameter of the guide member segments 42 and 44 that a snug but removable friction engagement fit is created between tube 46 and guide member segments 42 and 44. The junction tube 46 preferably includes a diametric anchor bore 48 at its middle region, through which either a stake 32 or stabilizer pin 38 fits. The junction tube 46 exterior surface and the platform mat 34 are preferably covered with hook and loop fastener material 52 to adhere together.

A golf apparatus 10 is further provided including an elongate guide member 20 having a guide member edge 20*a* which is shaped into an arc having a desired curvature substantially matching the arc of a certain desired swing of a golf clubhead 14. Apparatus 10 includes several clubface orientation markers 60, which are essentially flat blades 62 with mounting stems 64, for mounting longitudinally along the guide member edge 20*a* to indicate the proper or desired orientation of the clubhead at each point along the path of the swing. See FIGS. 8–12. The guide member 20 includes a series of clubface orientation marker mounting openings 66 along the guide member edge 20*a* into which the mounting stems 64 are fitted for removable engagement by friction. Once again, the guide member 20 is secured to the ground G with a guide member anchoring structure 30 so that the guide member 20 extends upwardly from the ground G. The guide member 20 preferably is flexible or semi-flexible to flex on contact with a golf club 12.

Figure 16:
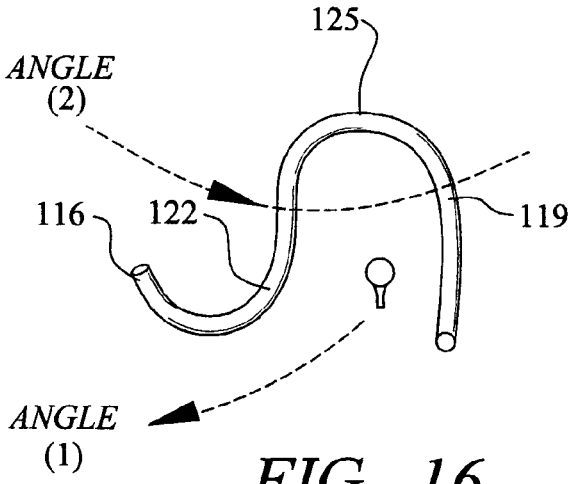
FIG. 16 is a rear perspective view of the swing paths.

The guide member segment 42 or 44 of guide member 20 may also be bent to form a U-shaped portion 113 with a tail 116 for perfecting the clubhead positioning relative to the ball B. See FIG. 16. The anchoring port 48 is shown anchored to the ground using the stabilizer pin 38. Respective parallel legs 119 and 122, and a connecting leg 125 of U-shaped portion 113 lie in a plane P which extends upwardly vertically from the ground. The tail 116 is perpendicular to leg 122 but bent outwardly from plane P. The golf ball B is placed on a golf tee forward of the tail 116. The clubhead 14 of golf club 12 is initially placed below and slightly forward of tail 116, behind golf ball B. During the back swing (arrow BS) the clubhead 14 passes under the tail 116 and goes up. Then during the forward or downswing (arrow DS) the clubhead 14 passes over the tail 116 and down to the golf ball B so as to properly impact the golf ball B. If the swing is improper and the clubhead 14 hits the tail 116, the whole U-shaped portion 113 distorts and remains distorted to provide the golfer an understanding of what went wrong during the swing.

Method 1

In practicing the invention, the following method may be used. The method for performing a practice swing of a golf club 12 using the above-described apparatus 10 includes the steps of initially attaching the anchoring port 48 to the end of the guide member 20 prior to first use of the apparatus 10; bending the guide member 20 such that the guide member edge 20*a* forms an arc substantially matching a desired golf clubhead 14 swing path S; securing the guide member 20 relative to the ground G with the guide member anchoring structure 30 in such an orientation relative to the ground G so as to define a desired swing path S relative to the ground G by extending the anchoring member 32 or 38 through the guide member bore 108 and affixing relative to the ground G; and swinging the club 12 along the guide member edge 20*a*.

Method 2

In practicing the invention, the following method may also be used. The method for performing a practice swing of a golf club 12 using the above-described apparatus 10 includes the steps of initially attaching the anchoring port 48 to the end of the guide member 20 prior to first use of the apparatus 10; bending the guide member 20 into a generally U-shaped portion 113 having respective parallel legs 119 and 122, and a connecting leg 125 that lie in a common plane P, and a tail 116 that is bent perpendicular to leg 122 outwardly from the plane of the U-shaped portion 113 such that tail 116 lies in a median position between a desired initial clubhead position prior to the back swing and a desired golf ball contacting clubhead position during the downswing prior to contacting the golf ball B; securing the guide member 20 relative to the ground G with the plane P extending vertically upwardly from the ground G with the tail 116 at the median position by extending the anchoring member 32 or 38 through the guide member bore 48 and affixing relative to the ground G; placing clubhead 14 at the desired initial clubhead position; and swinging the club 12 with the clubhead 14 passing under the tail 116 during the back swing and over the tail 116 during the downswing through the golf ball contacting position prior to contacting the golf ball B.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fail within the breadth and scope of the claims here appended.

I claim as my invention:

1. A golf instruction apparatus, comprising:

a malleable, elongated, guide member having a guide member edge and at least one free edge, said guide member which is bendable at ambient temperature by a user into an arc having a certain desired curvature substantially matching the arc of a desired swing of a golf clubhead, and which substantially retains the shape into which it is bent until reshaped by the user; and a guide member anchoring device adapted for attachment to an end of said guide member for securing said guide member to the ground to position said guide member extending upwardly from the ground such that a golfer is able to practice swinging a golf club at full speed along a desired swing path by swinging the head of the club along the arc of said guide member edge, and such that the malleable guide member yields to contact of the swinging golf clubhead and thereby prevents damage of tie golf clubhead and said guide member;

wherein said guide member comprises an outer foam material and an inner metal material.

2. The golf instruction apparatus as claimed in claim 1, wherein the guide member includes a bore.

3. The golf instruction apparatus as claimed in claim 2, further including an anchoring member comprising a spike adapted for extending through the guide member bore for insertion into the ground.

4. The golf instruction apparatus as claimed in claim 2, wherein the guide member anchoring device further includes a platform mat adapted for resting on the ground and having at least one port, a stabilizer pin adapted for extending through the guide member bore and fitting into said port.

5. The golf instruction apparatus as claimed in claim 1, further comprising a plurality of the clubface orientation markers individually insertable into respective of the series of the clubface orientation marker mounting openings along the guide member, each of said markers being orientable to indicate the desired golf clubhead orientation at a given point along said guide member.

6. The golf instruction apparatus as claimed in claim 1, wherein the guide member is flexible so as to flex on contact by a swinging golf clubhead.

7. The golf instruction apparatus as claimed in claim 1, wherein said guide member is penetrable by a portion of said anchoring device.

8. A golf instruction apparatus as claimed in claim 7, wherein said anchoring device comprises a golf tee.

9. A golf instruction apparatus, comprising:

a malleable, elongated guide member having a guide member edge and at least one free edge, said guide member which is bendable at ambient temperature by a user into an arc having a certain desired curvature substantially matching the arc of a desired swing of a golf clubhead, and which substantially retains the shape into which it is bent until reshaped by the user; and a guide member anchoring device adapted for attachment to said guide member for securing said guide member to the ground to position said guide member extending upwardly from the ground such that a golfer is able to practice swinging a golf club at full speed along a desired swing path by swinging the head of the club along the arc of said guide member edge, and such that the malleable guide member yields to contact of the swinging golf clubhead and thereby prevents damage of the golf clubhead and said guide member;

wherein said guide member comprises an outer foam material and an inner metal material.

10. The golf instruction apparatus as claimed in claim 9, further including an anchoring member comprising a spike adapted for extending through said guide member for insertion into the ground to support said guide member.

11. The golf instruction apparatus as claimed in claim 10, wherein said guide member anchoring device further includes a platform mat adapted for resting on the ground and having at least one port, a stabilizer pin adapted for extending through said guide member bore and fitting into said port thereby interconnecting said anchoring device with attached guide member to said platform mat, such that said platform mat functions as a stabilizing platform on which said guide member is supported on the ground.

12. A method of performing a practice swing of a golf club using an apparatus comprising a malleable, elongated guide member having a guide member edge and at least one free end, which guide member is bendable at ambient temperature by a user into an arc having a certain desired curvature substantially matching the arc of a desired swing of a golf clubhead, and which substantially retains the shape into which it is bent until reshaped by the user but yields to contact of the swinging golf clubhead and thereby prevents damage of the golf clubhead and the guide member, and an anchoring device which comprises an anchoring device adapted for attachment to the guide member to secure the guide member to the ground with the guide member extending upwardly from the ground, comprising the steps of:

bending the guide member at ambient temperature such that the guide member edge forms an arc substantially matching a desired golf clubhead swing path;

securing the guide member relative to the ground with the anchoring device in such an orientation relative to the ground as to define a desired swing path relative to the ground; and swinging the club along the guide member edge;

wherein said guide member comprises an outer foam material and an inner metal material.

13. The method as claimed in claim 12, wherein the step of securing the guide member relative to the ground comprises providing a spike and extending the spike through the guide member and into the ground.

14. The method as claimed in claim 13, wherein the step of securing the guide member relative to the ground comprises providing a platform mat having at least one port, resting the platform mat on the ground, and extending the stabilizer pin through the guide member and into the port to interconnect the anchoring device with attached guide member to the platform mat, such that the platform mat functions as a stabilizing platform on which the guide member is supported on the ground.

15. A method of performing a practice swing of a golf club using an apparatus comprising a malleable, elongated guide member having a foam exterior surrounding a bendable center wire, the guide member being bendable at ambient temperature by a user and substantially retains the shape into which it is bent until reshaped by the user, but yields to contact of the swinging golf clubhead thereby preventing damage of a golf clubhead and the guide member, and an anchoring device adapted for attachment to the guide member for securing the guide member to the ground, comprising the steps of:

bending the guide member to a desired position;

securing the guide member relative to the ground with the anchoring member through the guide member;

placing the clubhead at a desired initial clubhead position; and swinging the club with the clubhead passing along said guide member.

16. The method as claimed in claim 15, wherein the step of securing the guide member relative to the ground comprises providing a spike and extending the spike through a bore and into the ground.

17. The method as claimed in claim 15, wherein said guide member is bent into a generally U-shaped portion having respective parallel legs, and a connecting leg that lie in a common plane, and a tail that is bent perpendicular to the leg outwardly from the plane of the U-shaped portion such that the tail lies in a median position between a desired initial clubhead position prior to the back swing and a desired golf ball contacting clubhead position during the downswing prior to contacting the golf ball.

18. The method as claimed in claim 17, wherein said guide member is secured with the common plane extending upwardly from the ground with the tail at the median position by extending the anchoring member through a guide member bore and being affixed relative to the ground.

19. The method as claimed in claim 17, wherein said club is swung along said guide member under the tail during the back swing and over the tail during the downswing through the golf ball contacting position prior to contacting the golf ball.

* * * * *